US005127649A

United States Patent [19]

Carbonero

[11] Patent Number: 5,127,649

[45] Date of Patent: Jul. 7, 1992

[54] FOAM HOCKEY STICK BLADE COVER

[75] Inventor: Kurt K. Carbonero, Birmingham, Mich.

[73] Assignee: Pull-Buoy, Inc., Rochester Hills, Mich.

[21] Appl. No.: 813,861

[22] Filed: Dec. 26, 1991

[51] Int. Cl.[5] ..... A63B 59/12

[52] U.S. Cl. ..... 273/67 A

[58] Field of Search ..... 273/67 A, 67 DB, 67 DC

[56] References Cited

U.S. PATENT DOCUMENTS

| | | | |
|---|---|---|---|
| 1,687,736 | 10/1928 | Root | 273/67 A |
| 2,912,245 | 11/1959 | Gardner et al. | 273/DIG. 6 X |
| 3,880,423 | 4/1975 | Kreag | 273/67 DC X |
| 4,651,990 | 3/1987 | Profit | 273/67 DB X |

FOREIGN PATENT DOCUMENTS

| | | | |
|---|---|---|---|
| 698375 | 11/1964 | Canada | 273/67 A |
| 3229854 | 2/1984 | Fed. Rep. of Germany | 273/67 A |
| 108623 | 9/1943 | Sweden | 273/67 A |

OTHER PUBLICATIONS

Sports Illustrated, Apr. 3, 1972, p. 7, Thrills Without Spills.

*Primary Examiner*—Paul E. Shapiro

*Attorney, Agent, or Firm*—Reising, Ethington, Barnard, Perry & Milton

[57] ABSTRACT

A hockey stick safety cover (10) for disposing over the blade (14) and contiguous shaft portion (16) of a hockey stick (12) for providing cushion to reduce the danger of using a hockey stick (12) with a hard blade (14). The safety cover (10) includes a single length or block (18) of soft extruded plastic foam having a slit (20) disposed along the length for receiving and completely covering the hockey stick blade (14) and the contiguous shaft portion (16). The soft foam deforms around the slit (20) to receive and surround the blade (14) and contiguous shaft portion (16). The soft foam also provides a cushioned exterior for reducing the impact of the hockey stick (12) on persons or property. The light weight of the foam does not seriously impair the user's ability to manipulate the stick (12).

11 Claims, 1 Drawing Sheet

FOAM HOCKEY STICK BLADE COVER

TECHNICAL FIELD

The subject invention relates to hockey stick covers of the type for disposing over a hockey stick blade, and more particularly to covers of the type having cushion to reduce the danger of using a stick having a hard blade.

BACKGROUND OF THE INVENTION

In many hockey games safety is so important as to require the modification of normal hockey equipment. This is particularly true in schools or similar supervised recreational environments. Schools and other institutions own and use hockey sticks having hard plastic or wood blades which are very effective for controlling a puck, but which by their hard quality pose safety hazards for players not wearing safety pads. Since safety is very important in schools and other places, measures must be taken to reduce the potential for hard sticks to injure the hockey players. Purchasing pads for players to wear would be effective, but too expensive.

U.S. Pat. No. 2,912,245 to Gardner et al teaches placing a rubber sleeve over a hockey stick blade. However, the rubber sleeve disclosed does not cover the entire blade. Nor does the sleeve cover the contiguous shaft portion of the stick, which may also cause injury. Moreover, the thin rubber sleeve provides little cushion to soften the impact of the blade. And the relative weight of the rubber cover makes the stick more difficult to manipulate. This creates problems when the users are young children. Finally, the preferred embodiment of the rubber sleeve is relatively expensive since it requires that the sleeve be molded onto the blade.

U.S. Pat. No. 4,651,990 to Profit teaches a hockey stick blade cover which covers a portion of the blade and also the contiguous shaft portion. However, the cover is intended only to protect the blade, and not persons or objects struck by the blade: accordingly, the cover is itself hard plastic, which provides no cushion. Also, the cover does not cover the entire surface of the blade, leaving portions of the blade exposed which could injure a person even if the cover were made from a different, softer material.

SUMMARY OF THE INVENTION AND ADVANTAGES

A hockey stick safety cover for covering a hard hockey stick of the type having a shaft and a blade attached thereto to reduce the threat of the hockey stick causing injury to person or property. The blade forms a predetermined angle with a contiguous shaft portion. The blade has a length, a height and a thickness. The safety cover comprises a block of homogeneous solid material having a length, height and thickness greater than the blade and a receiving slit defining two opposing faces disposed along the length for receiving the entire blade and contiguous shaft portion into the material. The slit is narrower than the thickness of the blade. The safety cover is characterized by the material being flexible to allow the opposing faces to deform to receive the hockey stick blade and contiguous shaft portion, to allow the faces to close completely around the inserted blade and contiguous shaft portion and to provide cushion to reduce the impact of the blade and the contiguous shaft on persons and objects.

The light weight of the foam does not impair the user's ability to manipulate the stick. This is very important if the users are young children, who tend to have less strength. If the cover was heavier, the young children either could not use the stick, or would experience frustration in not being able to manipulate it well.

FIGURES IN THE DRAWINGS

Other advantages of the present invention will be readily appreciated as the same becomes better understood by reference to the following detailed description when considered in conjunction with the accompanying drawings wherein.

DETAILED DESCRIPTION OF THE PREFERRED EMBODIMENT

Figure 1:
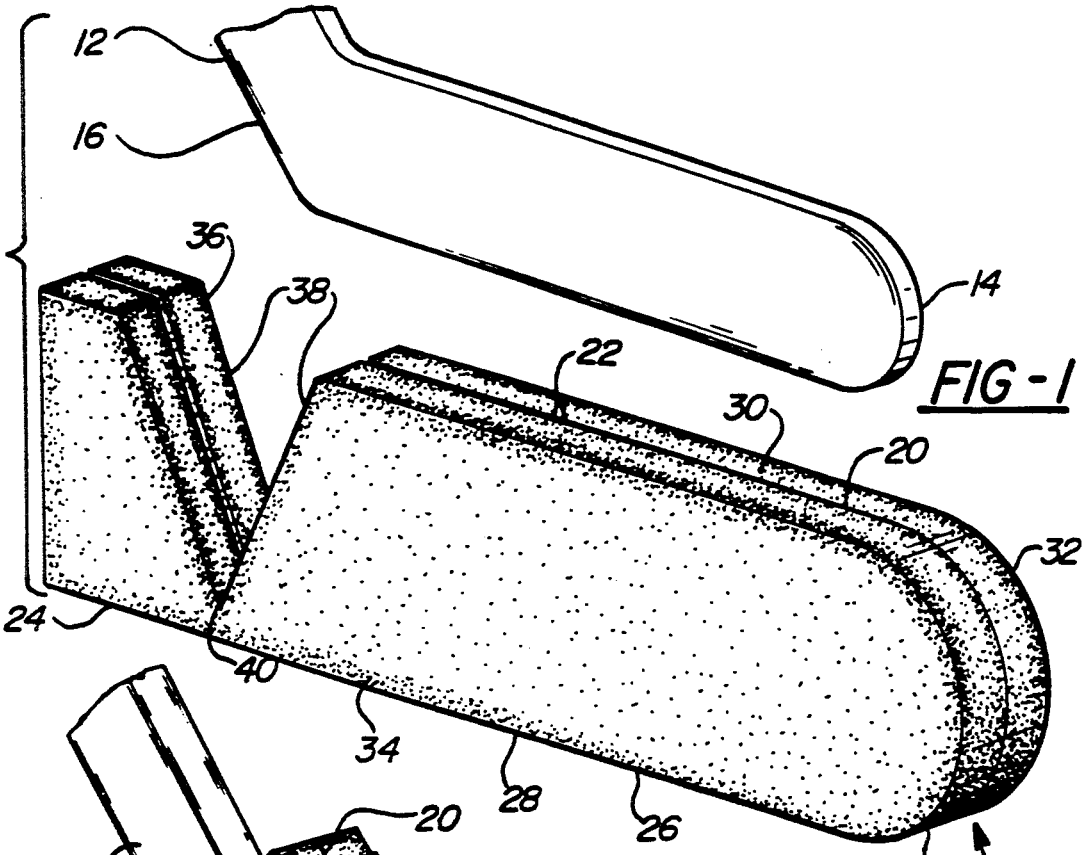
FIG. 1 is a perspective view of the subject invention.
Figure 2:
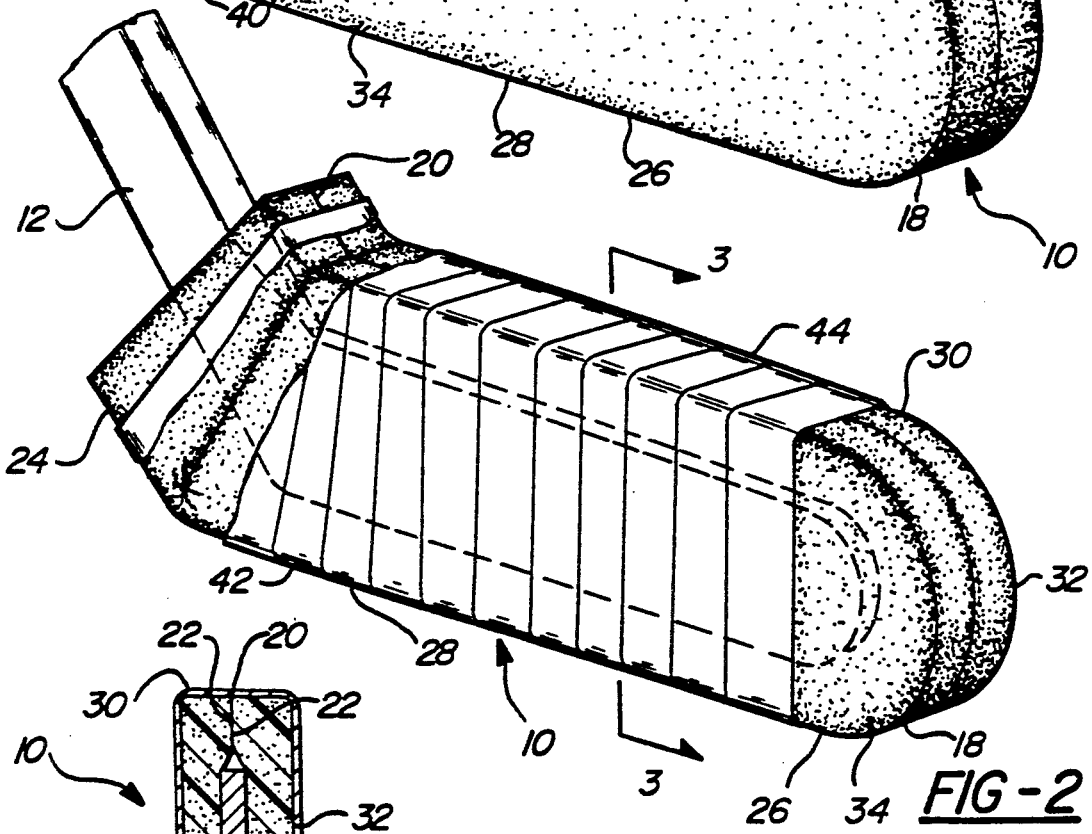
FIG. 2 is a perspective view of the subject invention disposed on a hockey stick with tape wrapped therearound.
Figure 3:
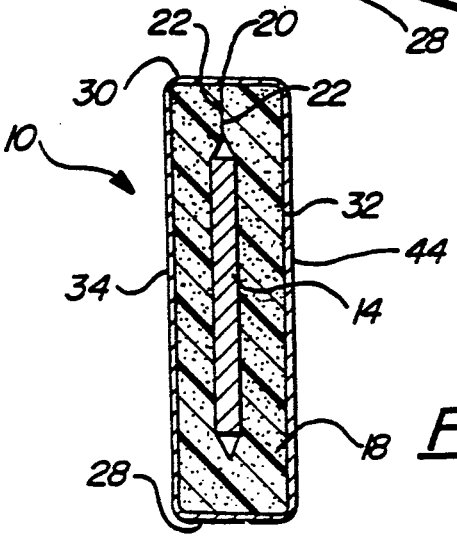
FIG. 3 is a cross-sectional view taken along line 3—3 of FIG. 2.

We disclose a hockey stick safety cover 10 for covering a hard hockey stick 12 of the type having a shaft and a blade 14 attached thereto to reduce the threat of the hockey stick 12 causing injury to person or property. The blade 14 forms a predetermined angle with a contiguous shaft portion 16. The blade 14 has a length, a height and a thickness. The safety cover 10 comprises a block 18 of homogeneous solid material having a length, height and thickness greater than the blade 14 and a receiving slit 20 defining two opposing faces 22 disposed along the length for receiving the entire blade 14 and contiguous shaft portion 16 into the material, the slit 20 being narrower than the thickness of the blade 14. The assembly is characterized by the material being flexible to allow the opposing faces 22 to deform to receive the hockey stick blade 14 and contiguous shaft portion 16, to allow the faces 22 to close completely around the inserted blade 14 and contiguous shaft portion 16 and to provide cushion to reduce the impact of the blade 14 and the contiguous shaft 16 on persons and objects.

The block 18 comprises soft plastic foam, preferably polyethylene foam sold under the trademark Ethofoam. This foam is extremely inexpensive to produce. It is extruded in sheets which can be procured "off-the-shelf." It need not be pre-molded to the desired shape since it can easily be cut into the desired shape. For example, one can acquire a plank-shaped sheet of foam polyethylene, use a table saw or other suitable machine or tool and cut the plank into the desired shape by cutting the plank to the desired length, rounding one end of the plank, cutting a "V" shaped notch, and cutting the slit 20 along one side of the plank. This material is also well adapted for the present purpose since it combines firmness with softness, and durability with light weight.

The block 18 includes a shaft end 24 for disposing over the contiguous shaft portion 16 and an oppositely disposed blade end 26 for disposing over the blade 14. The block 18 also includes a bottom side 28 for contacting the hockey playing surface, which can be a gym floor, a patch of grass, a street or an ice rink. The block 18 further includes an oppositely disposed top side 30. The bottom and top sides 28,30 are spaced apart by a mass of the foam material having a front 32 for contacting a hockey puck or ball and an oppositely disposed and spaced apart rear 34. It is along the top side 30 that the slit 20 is cut. The block 18 is also cut to have a rounded end.

The positioning and size of the slit 20 is very important. The slit 20 should extend from the shaft end 24 toward the blade end 26, but should not reach the blade end 26. In other words, the slit 20 will appear along the shaft end 24, but not along the blade end 26. Also, the slit 20 should extend from the top side 30 toward the bottom side 28, but should not reach the bottom side 28. Thus, no slit 20 will appear along the bottom side 28. The slit 20 should extend deep enough into the block 18 to receive the entire hockey blade 14. In other words, the depth of the slit 20 should exceed the height of the blade 14. This allows the blade 14 to be completely covered by the block 18. The slit 20 should also be deep enough so that there is at least one half inch of foam above and below the blade 14 of the hockey stick to provide sufficient cushion. This means that the slit 20 should come no closer to the bottom side 28 than one half inch, and that the slit 20 should be at least one half inch deeper than the height of the blade 14. Also, the slit 20 should be positioned roughly halfway between the front 32 and rear 34 of the block 18 so that there is adequate cushion covering the front and rear of the hockey blade 14. This cushion is also preferably $\frac{1}{2}''$-$\frac{5}{8}''$. One way to visualize the positioning of the slit 20 is as follows: if the slit 20 extended fully through the block 18 it would divide the block 18 into two symmetric halves. However, in the preferred embodiment, the slit 20 does not extend fully though the block 18.

The block 18 should also be cut to include a "V" shaped notch 36 disposed between the shaft end 24 and the blade end 26 and adjacent the shaft end 24. The notch 36 includes first and second spaced apart surfaces 38 converging at a vertex 40 disposed adjacent the bottom side 28. The surfaces 38 form an acute angle which should roughly equal the acute angle supplementary to the obtuse angle formed by the blade 14 and the contiguous shaft portion 16 of the hockey stick 12. The blade end 26 of the block 18 generally covers the hockey stick blade 14, while the shaft end 24 of the block 18 generally covers the contiguous shaft portion 16. The block 18 is also cut to have a rounded blade end 26.

The safety cover 10 should include fastening means 42 for fastening the safety cover 10 to the hockey stick 12. Preferably, the fastening means 42 includes tape 44 for winding around the safety cover 10 after the safety cover is disposed over the blade 14 and the contiguous shaft portion. The tape 44 should exert a squeezing force to force the faces 22 together to completely surround the blade 14 and contiguous shaft portion 16. The tape 44 can be any suitable tape, though common plastic or cloth sports tape is the preferred variety. Other fastening means 42 such as hook and loop fasteners sold under the trademark Velcro may be used to the same end.

To attach the safety cover 10 on the stick 12, the blade 14 is disposed in the receiving slit 20 at the blade end 26 of said safety cover 10. The material adjacent the slit 20 should deform or compress slightly to receive the blade 14. The shaft end 24 of the cover 10 pivots with respect to the blade 14 end about the vertex 40 of the "V" notch 36 so that the shaft portion fits in the receiving slit 20 at the shaft end 24 and so that the first and second surfaces 38 touch. When the first and second surfaces 38 touch, and the angle between them is closed, the shape of the cover 10 should resemble the portions of the hockey stick 12 which it covers. If the angle defined by the surfaces 38 is not properly chosen, the shape of the cover 10 will not match that of the stick portions. Also, just as the material deforms to receive the blade 14, the material deforms to receive the shaft. Since the shaft is usually thicker than the blade 14, the material in the shaft end 24 actually deforms more than the material in the blade end 26 in order to fully receive the shaft into the block 18. Once the blade 14 and contiguous shaft portion 16 is inserted into the block 18, tape 44 should be wound around the block to force the opposing faces 22 together to close the slit 20 and seal the blade 14 and contiguous shaft 16 within the block 18.

The invention has been described in an illustrative manner, and it is to be understood that the terminology which has been used is intended to be in the manner of words of description rather than words of limitation.

Obviously, many modifications and variations are possible in light of the above teachings. It is therefore to be understood that within the scope of the appended claims wherein reference numerals are merely for convenience and are not to be in any way limiting, the invention may be practiced otherwise than as specifically described.

We claim:

1. A hockey stick safety cover (10) for covering a hard hockey stick (12) of the type having a shaft and a blade (14) attached thereto to reduce the threat of the hockey stick (12) causing injury to person or property, the blade (14) forming a predetermined angle with a contiguous shaft portion (16), the blade (14) having a length, a height and a thickness; said safety cover (10) comprising:

a block (18) of homogeneous solid material having a length, height and thickness greater than the blade (14) and a receiving slit (20) defining two opposing faces (22) disposed along said length for receiving the entire blade (14) and contiguous shaft portion (16) into said material, said slit (20) being narrower than the thickness of the blade (14);

characterized by said material being flexible to allow said opposing faces (22) to deform to receive the hockey stick blade (14) and contiguous shaft portion (16), to allow said faces (22) to close completely around the inserted blade (14) and contiguous shaft portion (16) and to provide cushion to reduce the impact of the blade (14) and the contiguous shaft portion (16) on persons and objects.

2. A safety cover (10) as set forth in claim 1 further characterized by said block (18) comprising soft plastic foam.

3. A safety cover (10) as set forth in claim 2 further characterized by said block (18) comprising polyethylene foam.

4. A safety cover (10) as set forth in claim 3 further characterized by said block (18) including a shaft end (24) for disposing over the contiguous shaft portion (16), an oppositely disposed blade end (26) for disposing over the blade (14), a bottom side (28) for contacting a hockey playing surface and an oppositely disposed and spaced apart top side (30), said block (18) including a "V" shaped notch (36) disposed between said shaft end (24) and said blade end (26) and adjacent said shaft end (24), said notch (36) including first and second spaced apart surfaces (38) converging at a vertex (40) disposed adjacent said bottom side (28).

5. A safety cover (10) as set forth in claim 4 further characterized by including fastening means (42) for fastening said safety cover (10) to the hockey stick (12).

6. A safety cover (10) as set forth in claim 5 further characterized by said fastening means (42) comprising tape (44) for winding around said safety cover (10) after said safety cover is disposed over the blade (14) and said contiguous shaft portion (16) and for exerting a squeezing force to force said faces (22) together to completely surround the blade (14) and contiguous shaft portion (16).

7. A safety cover (10) as set forth in claim 4 further characterized by including a hockey stick (12) having a blade (14) and contiguous shaft portion (16) forming a predetermined angle with said blade (14), said blade disposed in said receiving slit (20) at said blade end (26) of said safety cover (10), said shaft end (24) of said cover pivoting with respect to said blade end (26) about said vertex (40) so that said contiguous shaft portion (16) fits in said receiving slit (20) at said shaft end (24) and so that said first and second surfaces (38) touch.

8. A safety cover (10) as set forth in claim 7 further characterized by including tape (44) wound around said safety cover (10) for exerting a squeezing force to force said faces (22) together to completely surround said blade (14) and contiguous shaft portion (16).

9. A safety cover (10) as set forth in claim 4 further characterized by said blade end (26) being rounded.

10. A safety cover (10) as set forth in claim 4 further characterized by said first and second surfaces (38) forming an acute angle equal to an acute angle supplementary to the obtuse angle formed by the blade (14) and contiguous shaft portion (16).

11. A safety cover (10) as set forth in claim 4 further characterized by said block (18) including a front (32) and a spaced apart rear (34), said front (32) and said rear (34) being generally perpendicular to said top and said bottom sides (28,30), said slit (20) extending through said block (18) from said top side (30) toward said bottom side (28) and generally parallel to and spaced apart from said front (32) and said rear (34).

* * * * *